US009321154B2

(12) United States Patent
Chen et al.

(10) Patent No.: US 9,321,154 B2
(45) Date of Patent: Apr. 26, 2016

(54) THROUGH-HOLE TYPE POWER RATCHET WRENCH

(71) Applicant: CHERVON (HK) LIMITED, Wanchai (HK)

(72) Inventors: Liang Chen, Nanjing (CN); Changxi Dai, Nanjing (CN); Junliu Zhang, Nanjing (CN)

(73) Assignee: CHERVON (HK) LIMITED, Wanchai (HK)

( * ) Notice: Subject to any disclaimer, the term of this patent is extended or adjusted under 35 U.S.C. 154(b) by 230 days.

(21) Appl. No.: 14/199,170

(22) Filed: Mar. 6, 2014

(65) Prior Publication Data

US 2014/0260835 A1 Sep. 18, 2014

(30) Foreign Application Priority Data

Mar. 12, 2013 (CN) ..... 2013 1 0077448

(51) Int. Cl.
*B25B 21/00* (2006.01)
*B25B 21/02* (2006.01)
*B25B 13/46* (2006.01)

(52) U.S. Cl.
CPC ..... *B25B 21/004* (2013.01); *B25B 21/02* (2013.01); *B25B 13/463* (2013.01)

(58) Field of Classification Search
CPC ..... B25B 21/004; B25B 21/02; B25B 13/463
USPC ..... 81/57.4, 57.2, 57.21, 57.13, 57.39, 62, 81/448, 464
See application file for complete search history.

(56) References Cited

U.S. PATENT DOCUMENTS 2,097,594 A * 11/1937 Kress ..... B25B 13/463 192/43.1
2,264,012 A * 11/1941 Wasson ..... B25B 21/004 74/129
2,719,446 A * 10/1955 Ford ..... B25B 21/004 81/179
2,719,447 A * 10/1955 Ford ..... B25B 21/004 81/183
3,386,319 A * 6/1968 Bloom ..... B25B 21/004 81/57.35
4,346,630 A * 8/1982 Hanson ..... B25B 21/004 81/57.13
5,450,773 A * 9/1995 Darrah ..... B25B 21/004 81/57.39
5,783,192 A * 7/1998 Willemse ..... A61K 39/245 424/184.1
6,282,990 B1 * 9/2001 Miner ..... B25B 21/004 81/57.11
6,308,594 B1 * 10/2001 Cheng ..... B25B 13/463 81/62
6,490,953 B2 * 12/2002 Horvath ..... B25B 21/004 81/57.39
6,510,765 B2 * 1/2003 Mu-Lin ..... B25B 13/463 81/60
6,578,643 B2 * 6/2003 Izumisawa ..... B25B 21/004 173/104

* cited by examiner

*Primary Examiner* — Hadi Shakeri
*Assistant Examiner* — Danny Hong
(74) *Attorney, Agent, or Firm* — Greenberg Traurig, LLP

(57) ABSTRACT

A through-hole type power ratchet wrench includes a socket bracket, a swingable member, a ratchet socket, first and second pawls, and first and second resilient elements. The swingable member is disposed in the socket bracket and adjacent to an outer surface of the ratchet socket. The pawls are swingably fixed on the swingable member. The pawls, biased by the respective resilient elements, tend to engage with the outer surface of the ratchet socket. The wrench also includes a limiting member configured to isolate one of the first and second pawls from the ratchet socket. The limiting member is formed with an opening adapted for allowing one of the pawls to pass therethrough, and the limiting member is moveable about the ratchet socket between first and second positions. The opening of the limiting member faces towards the first pawl and second pawls when at the first and second positions, respectively.

14 Claims, 4 Drawing Sheets

THROUGH-HOLE TYPE POWER RATCHET WRENCH

CLAIM OF PRIORITY UNDER 35 U.S.C. §119

The present Application for Patent claims priority to Chinese Application No. 201310077448.9 entitled "Through-hole Type Power Ratchet Wrench" filed Mar. 12, 2013, and assigned to the assignee hereof and hereby expressly incorporated by reference herein.

FIELD OF THE INVENTION

The present invention relates to a wrench, and particularly to a through-hole type power ratchet wrench having a reversal function.

BACKGROUND OF THE INVENTION

A power ratchet wrench is widely applied in the field of fastening operations, and particularly a through-hole type power ratchet wrench is adapted for some narrow operating environments as having a smaller operating head. Generally, a rotation direction of a ratchet socket at a head portion of the ratchet wrench may be changed by manually reversing the ratchet wrench. However, it is very difficult for an operator to reverse the ratchet wrench in some especially narrow operation environments. The operator needs to draw the ratchet wrench out of the operating environment first, reverse it, and then replace it into the operation environment again. Obviously, this will adversely affect the operation efficiency of the operator.

SUMMARY OF THE INVENTION

A technical problem to be solved by the present invention is to provide a through-hole type power ratchet wrench which may conveniently change a rotation direction of a ratchet socket.

To solve the above problem, the various embodiments of the present invention provide a through-hole type power ratchet wrench, comprising a socket bracket, a swingable member, a ratchet socket, a first pawl and a second pawl. The swingable member is swingably mounted in the socket bracket and adjacent to an outer surface of the ratchet socket. The first pawl and second pawl are swingably fixed on the swingable member and a resilient element is connected between the first pawl and the swingable member and between the second pawl and the swingable member respectively, the first pawl and second pawl, biased by the respective resilient element, having a tendency of engaging with the outer surface of the ratchet socket. The through-hole type power ratchet wrench further comprises a limiting member disposed between the first pawl, the second pawl and the ratchet socket and configured to isolate one of the first pawl and the second pawl from the ratchet socket. The limiting member is formed with an opening adapted for allowing one of the first pawl and second pawl to pass therethrough, and is moveable about the ratchet socket between a first position where the opening of the limiting member faces towards the first pawl and a second position where the opening of the limiting member faces towards the second pawl.

As an improvement, the opening comprises a first opening portion adapted for passage of the first pawl and a second opening portion adapted for passage of the second pawl.

As an improvement, the through-hole type power ratchet wrench further comprises a control element which is connected to the limiting member and exposed out of a socket bracket in a normal state.

Specifically, the control element is a driving lever, and the limiting member is further provided with an insertion slot into which the driving lever is inserted.

As a specific embodiment, the limiting member is C-shaped or O-shaped tab.

As an improvement, an inner peripheral surface of the swingable member facing towards the limiting member is formed with a limiting portion, and the limiting member is formed with a positioning portion engageable with the limiting portion, the limiting portion and positioning portion coming into engagement when the limiting member moves to the first position or second position.

Specifically, the limiting portion is arranged as a plurality of concave portions that are uniformly distributed on the inner peripheral surface of the swingable member facing towards the limiting member, and the positioning portion is arranged as a plurality of convex portions symmetrically disposed on the limiting member and being engageable with the concave portions.

As an improvement, uniformly distributed ribs are formed on the inner peripheral surface of the ratchet socket, and a groove is formed at the same position on each of the ribs, and the ratchet socket further comprises a limiting element fixed in the groove.

Specifically, the limiting element is a C-shaped or O-shaped steel wire ring.

As a specific embodiment, the through-hole type power ratchet wrench further comprises a motor, a decelerating gear mechanism and an eccentric shaft, the motor is connected to the eccentric shaft via the decelerating gear mechanism, an eccentric driving portion is formed at a front end face of the eccentric shaft, and a receiving portion for receiving the driving portion is formed at a rear end of the swingable member.

Specifically, the motor is an electric motor or pneumatic motor.

Specifically, the driving portion is a shaft protrusion around which a roller is mounted, and the receiving portion is a semi-circular notch.

Specifically, the decelerating gear mechanism is a planetary decelerating gear.

As a further embodiment, the through-hole type power ratchet wrench further comprises a striking mechanism disposed between the motor and the decelerating gear mechanism or between the decelerating gear mechanism and eccentric shaft, wherein the striking mechanism comprises a mandrel, a hammer and a hammer anvil, and wherein the mandrel is formed with a first recess, and an inner peripheral surface of the hammer is formed with a second recess, and the hammer is sleeved with the mandrel via a roller received between the first recess and second recess, a first protrusion being formed on an end face of the hammer facing towards the hammer anvil, and a second protrusion engageable with the first protrusion by sides thereof being formed on an end face of the hammer anvil facing towards the hammer, and the hammer being further connected with a resilient element, and the hammer, biased by the resilient element, having a tendency of moving towards the hammer anvil.

The limiting member of the through-hole type power ratchet wrench according to the present invention is formed with an opening adapted for allowing the first pawl and second pawl to pass therethrough, and the limiting member is moveable about the ratchet socket between a first position and a second position; when at the first position, the opening of the limiting member faces towards the first pawl; when at the second position, the opening of the limiting member faces towards the second pawl. The change of the rotation direction of the ratchet socket is achieved by means of changing the position of the limiting member, thereby simplifying an operator's operation of reversing the ratchet wrench in a narrow operating environment and improving operating efficiency.

Specific parts are designated by the following reference numbers:

10, 20: through-hole type power ratchet wrench; 11: socket bracket; 12: swingable member; 120: limiting portion; 121 receiving portion; 13: ratchet socket; 130: ratchet; 131: rib; 132: groove; 133: limiting element; 14: first pawl; 15: second pawl; 16 limiting member; 160: positioning portion; 161: first opening; 162: second opening; 17: control element; 21, 21': motor; 22, 22': decelerating gear mechanism; 23, 23': eccentric shaft; 231: driving portion; 24: striking mechanism; 240: mandrel; 241: hammer; 242: hammer anvil.

DETAILED DESCRIPTION OF PREFERRED EMBODIMENTS

To facilitate description, "left", "right", "clockwise" and "counter-clockwise" described below are all consistent with directions shown in the figures.

Figure 1:
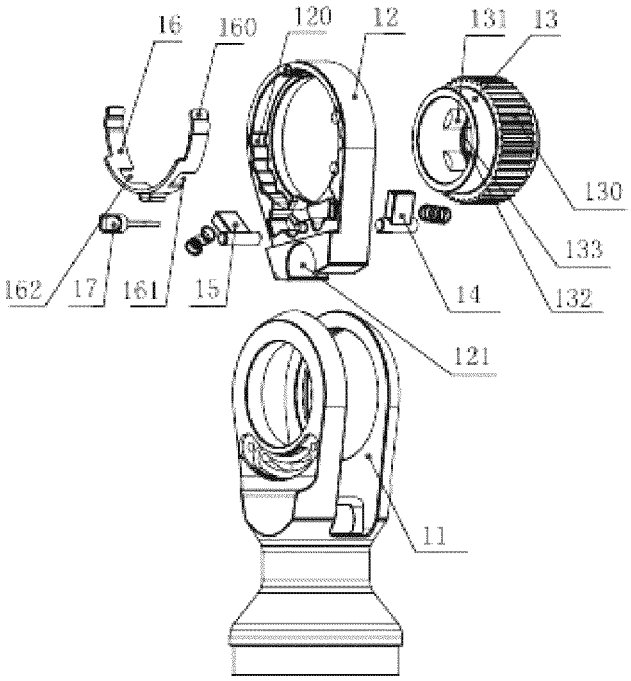
FIG. 1 is an exploded view of a head assembly of a through-hole type power ratchet wrench according to one embodiment of the present invention.

Referring to FIG. 1, a head assembly of a through-hole type power ratchet wrench 10 according to one embodiment of the present invention comprises a socket bracket 11, a swingable member 12, a ratchet socket 13, a first pawl 14 and a second pawl 15. The swingable member 12 is swingably disposed in the socket bracket 11 and adjacent to an outer surface of the ratchet socket 13. The first pawl 14 and second pawl 15 are swingably fixed on the swingable member 12. A first resilient element is connected between the first pawl 14 and the swingable member 12. A second resilient element is connected between the second pawl 14 and the swingable member 12. The first pawl 14 and second pawl 15, biased by the respective resilient elements, has a tendency of engaging with the outer surface of the ratchet socket 13. The outer surface of the ratchet socket 13 has ratchets 130, and front ends of the first pawl 14 and second pawl 15 are square teeth and are adapted to angularly engage with the ratchet 130. If the first pawl 14 engages with the ratchet socket 13, the pawl 14 slides over the ratchet 130 when the swingable member 12 swings to the left, and the ratchet 14 abuts against the ratchet 130 and forces the ratchet socket 13 to rotate in a second direction (counter-clockwise direction) when the swingable member 12 swings to the right. If the second pawl 15 engages with the ratchet socket 13, the second pawl 15 abuts against the ratchet 130 and forces the ratchet socket 13 to rotate in a first direction (clockwise direction) when the swingable member 12 swings to the left; and the second pawl 15 slides over the ratchet 130 when the swingable member 12 swings to the right. Hence, the rotation direction of the ratchet socket 13 may be controlled by selecting the first pawl 14 or second pawl 15 to engage the outer surface of the ratchet socket 13.

The head assembly of the through-hole type power ratchet wrench 10 further comprises a limiting member 16 disposed between the first pawl 14, the second pawl 15 and the ratchet socket 13 and configured to isolate the first pawl 14, second pawl 15 from the ratchet socket 13. The limiting member 16 is formed with an opening adapted for allowing the first pawl 14 and second pawl 15 to pass therethrough, and is moveable about the ratchet socket 13 between a first position and a second position. At the first position, the opening faces towards the first pawl 14, and as a result, the first pawl 14 passes through the opening and engages with the ratchet socket 13 while the second pawl 15 is isolated by the limiting member 16, and thus, the ratchet socket 13 can only rotate in the second direction (counter-clockwise direction); at the second position, the opening faces towards the second pawl 15, as a result, the first pawl 14 is isolated by the limiting member 16, while the second pawl 15 passes through the opening and engages with the ratchet socket 13, and thus, the ratchet socket 13 can only rotate in the first direction (clockwise direction). As an improvement, the opening of the limiting member 16 comprises a first opening portion 161 adapted for passage of the first pawl 14 and a second opening portion 162 adapted for passage of the second pawl 15. A distance between opposed edges of the first opening portion 161 and second opening portion 162 is defined as L1, and a distance between tips of the first pawl 14 and second pawl 15 in contact with the ratchet 130 of the ratchet socket 13 is defined as L2. Specifically, the distance L1 and distance L2 are designed unequal, i.e., the distance L1 may be greater than or less than distance L2. Hence, in the same time period, the limiting member 16 only allows one of the first pawl 14 and the second pawl 15 to engage with the ratchet socket 13, i.e., the rotation direction of the ratchet socket 13 may be controlled by driving the limiting member 16 to select the pawl engaging with the ratchet socket 13. Furthermore, the design of the two opening portions (161, 162) may reduce movement distance of the limiting member 16 between the first position and second position, facilitating the operator to control with one hand.

Figure 2:
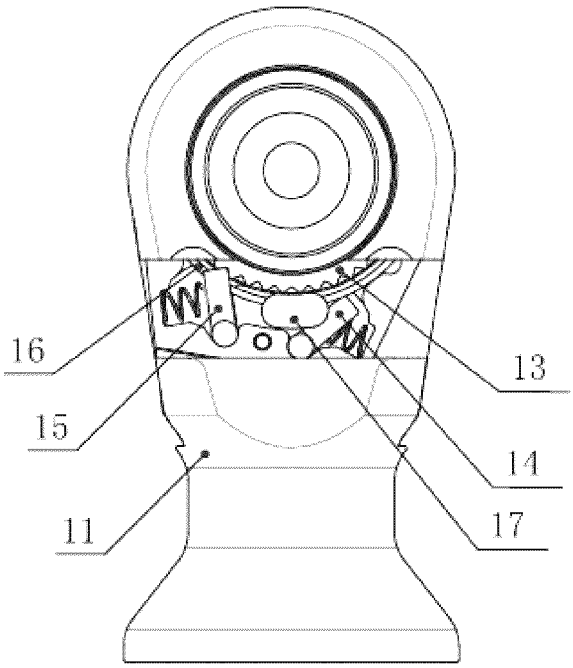
FIG. 2 is a schematic view of the head assembly when the through-hole type power ratchet wrench according to one embodiment of the present invention is driven in a first direction.
Figure 3:
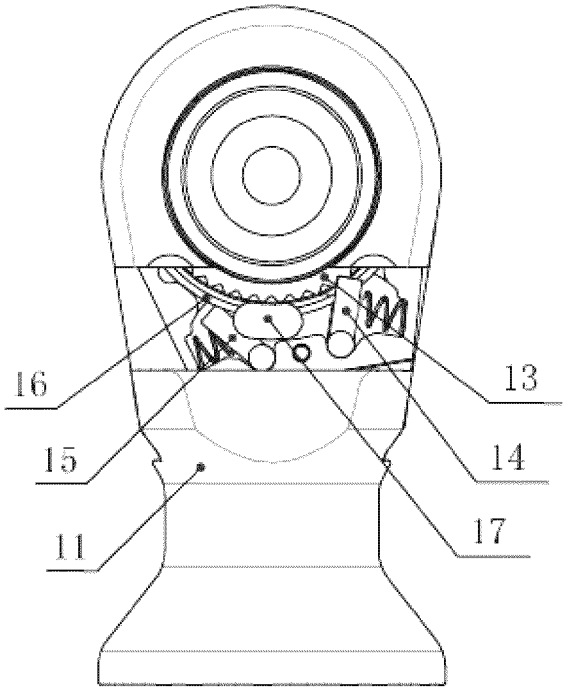
FIG. 3 is a schematic view of the head assembly when the through-hole type power ratchet wrench according to one embodiment of the present invention is driven in a second direction.

Referring to FIGS. 2 and 3, when the limiting member 16 is driven towards the right, the pawl 14 is isolated by the limiting member 16, while the pawl 15 may pass through the second opening portion 162 to engage with the outer surface of the ratchet socket 13, whereupon the ratchet socket 13 is only allowed for rotation in the first direction (clockwise direction); when the limiting member 16 is driven towards the left, the pawl 14 may pass through the first opening portion 161 to engage with the outer surface of the ratchet socket 13, while the pawl 15 is isolated by the limiting member 16, whereupon the ratchet socket 13 is only allowed for rotation in the second direction (counter-clockwise direction). The limiting member 16 may have various embodiments, for example, it may be a C-shaped tab with a radius greater than the ratchet socket 13; for example, it may further be an O-shaped tab surrounding the ratchet socket 13, and so on. According to such design, an axial dimension of the limiting member 16 will not exceed an axial scope of the outer surface of the ratchet socket 13, and the tab-shaped limiting member 16 will not increase the length of the through-hole type power ratchet wrench 10 and thereby facilitates operation of the ratchet wrench in a narrow operating environment.

As an improvement, the head assembly of the through-hole type power ratchet wrench 10 further comprises a control element 17 which is connected to the limiting member 16 and exposed out of a socket bracket 11 in a normal state. The operator may manually operate the control element 17 to rotate the limiting member 16 and thereby change the rotation direction of the ratchet socket 13. In addition, a position where the control element 17 is exposed out of the socket bracket 11 and a position where a switch trigger (not notated) for activating the through-hole type power ratchet wrench 10 is mounted on a housing (not notated) are located on an upper side and a lower side of the through hole ratchet wrench 1 respectively, and both of them are located in a position reachable by the operator's hand. Hence, the operator may operate the through-hole type power ratchet wrench 10 with one hand. The control element 17 may have various embodiments, for example, the control element 17 may be a driving lever (not notated), and the limiting member 16 is correspondingly provided with an insertion slot (not notated) so that the control element 17 in the form of the driving lever may be inserted into the insertion slot and thereby mechanically linked to the limiting member 16. For example, the control element 17 may also be a shifting fork (not shown) integrally formed with the limiting member 16.

In one embodiment, an inner peripheral surface of the swingable member 12 facing towards the limiting member 16 is formed with uniformly distributed limiting portions 120, and the limiting member 16 are formed with positioning portions 160 mateable with the limiting portions 120, and a position where the limiting portions 120 mate with the positioning portion 160 corresponds to a position where the first pawl 14 and second pawl 15 face towards the first opening portion 161 and the second opening portion 162. Combinations of the limiting portions 120 and the positioning portions 160 may be implemented in many modes. For example, the limiting portions 120 may be a plurality of concave portions that are uniformly distributed on the inner peripheral surface of the swingable member 12 facing towards the limiting member 16, and the positioning portions 160 may be a plurality of convex portions that are correspondingly disposed on a surface of the limiting member 16 facing towards the inner peripheral surface of the swingable member 12. For example, on the inner peripheral surface of the swingable member 12 facing towards the limiting member 16 are constructed a pair of recesses (not shown) in which are provided rollers (not shown) connected to a resilient element and serving as the limiting portion 120, while notches (not shown) serving as the positioning portion 160 are correspondingly disposed on the surface of the limiting member 16 facing towards the inner peripheral surface of the swingable member 12, and so on. When the limiting member 16 is rotated to enable one of the first pawl 14 and second pawl 15 to engage with the outer surface of the ratchet socket 13 through the first opening portion 161 and the second opening portion 162, and since the limiting portion 120 mates with the positioning portion 160, the position of the limiting member 16 is fixed such that an unwanted leap of the limiting member 16 in operation is avoided.

Uniformly distributed ribs 131 are formed on the inner peripheral surface of the ratchet socket 13 of the through-hole type power ratchet wrench 10, and a groove 132 is formed at the same position at each rib, and the ratchet socket 13 further comprises a limiting element 133 fixed in the groove 132. The limiting element 133 may be implemented in many modes. For example, it may be a C-shaped steel wire ring which has a radius slightly greater than the ratchet socket 13 and may be embedded in the groove 132; and for example, it may also be a O-shaped steel wire ring which has a radius equivalent to the inner peripheral surface of the ratchet socket 13 and may be embedded in the groove 132; and so on. Hence, the ratchet socket 13 is adapted to cooperate with an adapter socket (not shown) which surface is provided with uniformly distributed recesses and annular indentations so that the through-hole type power ratchet wrench 10 may operate on fasteners such as bolts or nuts of different specifications.

Figure 4:
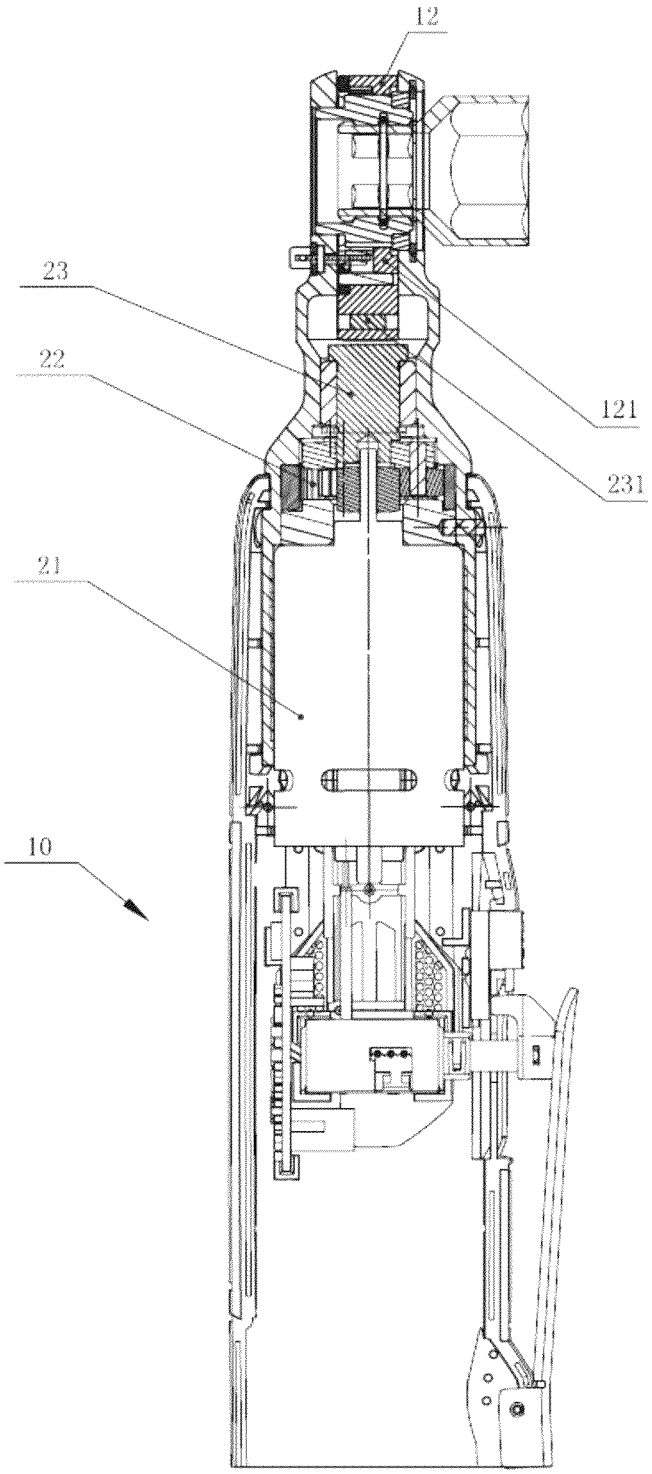
FIG. 4 is a sectional view of the through-hole type power ratchet wrench according to one embodiment of the present invention.

Referring to FIG. 4, the through-hole type power ratchet wrench 10 further comprises a motor 21, a decelerating gear mechanism 22 and an eccentric shaft 23. The motor 21 is connected to the eccentric shaft 23 via the decelerating gear mechanism 22, i.e., output of the motor 21 is transferred to the eccentric shaft 23 after deceleration. The motor 21 may be an electric motor or pneumatic motor. The decelerating gear mechanism 22 is a set of planetary decelerating gears. An eccentric driving portion 231 is formed on a front end of the eccentric shaft 23, and a receiving portion 121 for receiving the driving portion 231 is formed at a rear end of the swingable member 12. Specifically, the driving portion 231 is a shaft protrusion around which a roller is provided, and the receiving portion 121 is a semi-circular notch constructed at the rear end of the swingable member 12. Hence, the driving portion 231 is rotated along with the eccentric shaft 23 and, in cooperation with the receiving portion 121, drives the swingable member 12 to swing such that the ratchet socket 13 is driven to rotate through one of the first pawl 14 and second pawl 15.

Figure 5:
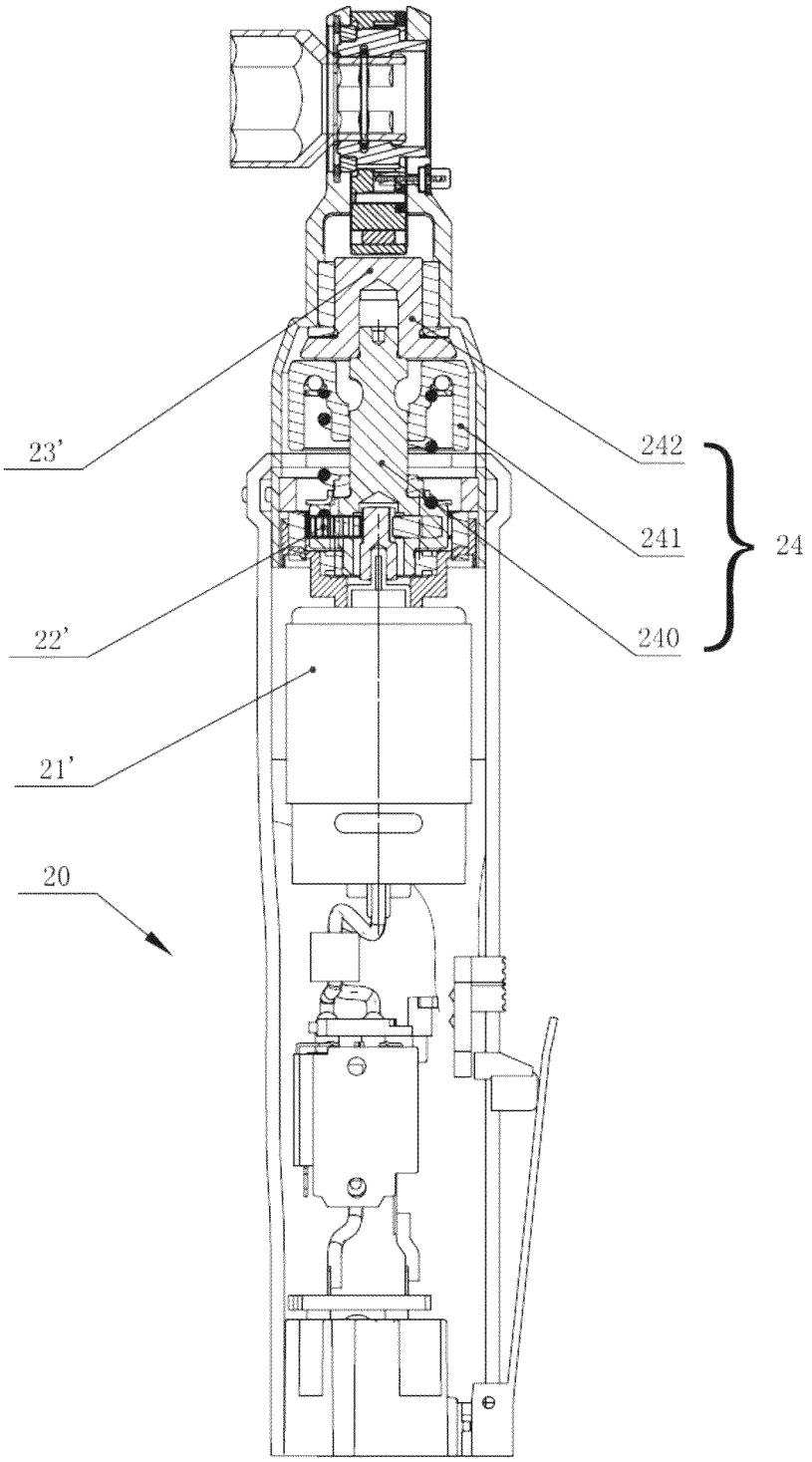
FIG. 5 is a sectional view of the through-hole type power ratchet wrench according to another embodiment of the present invention.

Referring to FIG. 5, a through-hole type power ratchet wrench 20 in another embodiment is similar to the through-hole type power ratchet wrench 10, and a main difference thereof lies in that the through-hole type power ratchet wrench 20 further comprises a striking mechanism 24 disposed between the motor 21' and the decelerating gear mechanism 22' or between the decelerating gear mechanism 22' and eccentric shaft 23'. The striking mechanism 24 comprises a mandrel 240, a hammer 241 and a hammer anvil 242. The mandrel 240 is formed with a first recess (not shown), the inner peripheral surface of the hammer 241 is formed a second recess (not shown), and the hammer 241 is sleeved with the mandrel 240 via a roller (not shown) received between the first recess and second recess. Hence, the mandrel 240 may transfer a torque to the hammer 241 via the roller. If the striking mechanism 24 is disposed between the motor 21' and the decelerating gear mechanism 22', the mandrel 240 is connected to an output end of the motor 21'; if the striking mechanism 24 is disposed between the decelerating gear mechanism 22' and the eccentric shaft 23', the mandrel 240 is connected to an output end of the decelerating gear mechanism 22. A first protrusion (not shown) is formed on an end face of the hammer 241 facing towards the hammer anvil 242, and a second protrusion (not shown) being engageable with the first protrusion by sides is formed on an end face of the hammer anvil 242 facing towards the hammer 241. Hence, the hammer 241 may transfer torque to the hammer anvil 242 through the cooperation of the first protrusion and second protrusion. If the striking mechanism 24 is disposed between the motor 21' and the decelerating gear mechanism 22', the hammer anvil 242 is connected to an input end of the decelerating gear mechanism 22'; if the striking mechanism 24 is disposed between the decelerating gear mechanism 22' and the eccentric shaft 23', the hammer anvil 242 is connected to an input end of the eccentric shaft 23', or the hammer anvil 242 may be integrally formed with the eccentric shaft 23'. The hammer 241 is further connected to a resilient element (not shown), and the hammer 241, biased by the resilient element, tends to move towards the hammer anvil 242. Hence, when the through-hole type power ratchet wrench 20 is in a normal output state, the hammer 241 transfers torque to the hammer anvil 242 through the cooperation of the first protrusion and second protrusion; when the output of through-hole type power ratchet wrench 20 is blocked, the hammer 241 retreats a certain distance against the biasing of the spring element, and the first protrusion and second protrusion separate correspondingly, then the hammer 241, biased by the spring element, rotationally moves forward, as a result, the first protrusion and second protrusion meet on sides correspondingly to achieve a striking Furthermore, when the output is blocked constantly, the above procedure occurs repeatedly so as to intermittently generate an increased impact torque.

The through-hole type power ratchet wrench 10, 20 according to various embodiments of the present invention is adapted for fastening operations in a narrow operating environment. The operator may hold the through-hole type power ratchet wrench 10, 20 with one hand and extend it into the narrow operating environment for fastening operation. When the rotation direction of the ratchet socket 13 needs to be changed, the hand that holds the wrench may drive the control element 17 with a finger for operation without removing the through-hole type power ratchet wrench 10, 20 out of the operating environment, thereby effectively improving the fastening operation efficiency. Additionally, the construction of the reversing mechanism of the through-hole type power ratchet wrench 10, 20 according to various embodiments of the present invention does not increase the size of the head portion of the tool, and the wrench is structurally simple and not liable to malfunction and exhibits a long service life.

Specific embodiments described above only illustrate the ideas and principles of the present invention and are not intended to limit the content of the present invention. Those having ordinary skill in the art may recognize that, in addition to the above preferred specific embodiments, the present invention has many other alternative or modified embodiments which still fall within the scope of the present invention. The scope of the present invention is defined by the appended claims.

What is claimed is:

1. A through-hole type power ratchet wrench, comprising:
a socket bracket;
a swingable member;
a ratchet socket;
a first pawl;
a second pawl;
a first resilient element; and
a second resilient element,
the swingable member being mounted in the socket bracket and adjacent to an outer surface of the ratchet socket and swingable relative to the socket bracket,
the first pawl and the second pawl respectively being connected to and swingable relative to the swingable member,
the first resilient element being provided between the first pawl and the swingable member,
the second resilient element being provided between the second pawl and the swingable member,
the first pawl and second pawl, biased respectively by the resilient element and the second resilient element, tending to engage with the outer surface of the ratchet socket,
wherein the through-hole type power ratchet wrench further comprises a limiting member disposed between the first and second pawls and the ratchet socket and configured to isolate one of the first pawl and the second pawl from the ratchet socket, the limiting member being formed with an opening adapted for allowing one of the first pawl and second pawl to pass therethrough, and the limiting member being moveable about the ratchet socket between a first position where the opening of the limiting member faces towards the first pawl and a second position where the opening of the limiting member faces towards the second pawl.

2. The through-hole type power ratchet wrench according to claim 1, wherein the opening comprises a first opening portion adapted for passage of the first pawl and a second opening portion adapted for passage of the second pawl.

3. The through-hole type power ratchet wrench according to claim 1, further comprising a control element which is connected to the limiting member and exposed to the socket bracket in a normal state.

4. The through-hole type power ratchet wrench according to claim 3, wherein the control element is a driving lever, and the limiting member is further provided with an insertion slot into which the driving lever is inserted.

5. The through-hole type power ratchet wrench according to claim 1, wherein the limiting member is C-shaped or O-shaped tab.

6. The through-hole type power ratchet wrench according to claim 1, wherein an inner peripheral surface of the swingable member facing towards the limiting member is formed with a limiting portion, and the limiting member is formed with a positioning portion for engaging with the limiting portion, wherein the limiting portion and positioning portion come into engagement when the limiting member moves to the first position or second position.

7. The through-hole type power ratchet wrench according to claim 6, wherein the limiting portion comprises a plurality of concave portions that are uniformly distributed on the inner peripheral surface of the swingable member facing towards the limiting member, and the positioning portion comprises a plurality of convex portions that are correspondingly disposed on the limiting member and engageable with the concave portions.

8. The through-hole type power ratchet wrench according to claim 1, wherein uniformly distributed ribs are formed on the inner peripheral surface of the ratchet socket, and a groove is formed on each of the ribs at the same position, the ratchet socket further comprising a limiting element fixed in the groove.

9. The through-hole type power ratchet wrench according to claim 8, wherein the limiting element is a C-shaped or O-shaped steel wire ring.

10. The through-hole type power ratchet wrench according to claim 1, further comprising:
a motor;
a decelerating gear mechanism; and
an eccentric shaft,
the motor being connected to the eccentric shaft via the decelerating gear mechanism,
an eccentric driving portion being formed on a front end of the eccentric shaft, and
a receiving portion for receiving the driving portion being formed at a rear end of the swingable member.

11. The through-hole type power ratchet wrench according to claim 10, wherein the motor is an electric motor or pneumatic motor.

12. The through-hole type power ratchet wrench according to claim 10, wherein the driving portion is a shaft protrusion around which a roller is mounted, and the receiving portion is a semi-circular notch.

13. The through-hole type power ratchet wrench according to claim 10, wherein the decelerating gear mechanism is a planetary decelerating gear mechanism.

14. The through-hole type power ratchet wrench according to claim 10, further comprising a striking mechanism disposed between the motor and the decelerating gear mechanism or between the decelerating gear mechanism and the eccentric shaft, wherein the striking mechanism comprises a mandrel, a hammer and a hammer anvil, the mandrel being formed with a first recess, an inner peripheral surface of the hammer being formed with a second recess, and the hammer being sleeved with the mandrel via a roller received between the first recess and second recess, a first protrusion being formed on an end face of the hammer facing towards the hammer anvil, and a second protrusion engageable with the first protrusion by sides thereof being formed on an end face of the hammer anvil facing towards the hammer, and wherein the hammer is further connected with an elastic element, and the hammer, biased by the elastic element, tends to move towards the hammer anvil.

* * * * *